US005810395A

United States Patent [19]

Morgan

[11] Patent Number: 5,810,395

[45] Date of Patent: Sep. 22, 1998

[54] METHOD FOR RECORDING AND TRACKING THE PROGRESS OF ACTIVITIES

[76] Inventor: Dale C. Morgan, P.O. Box 811, Prospect, Ky. 40059

[21] Appl. No.: 777,492

[22] Filed: Dec. 30, 1996

[51] Int. Cl.[6] ..... B42D 15/00

[52] U.S. Cl. ..... 283/70; 283/67; 283/115; 434/108; 434/238; 434/430

[58] Field of Search ..... 283/2, 3, 4, 115, 283/117, 900, 67, 70; 40/107; 434/108, 238, 430; D19/20

[56] References Cited

U.S. PATENT DOCUMENTS 1,542,456 6/1925 Johns .
1,603,340 10/1926 Hubbell .
1,723,648 8/1929 Hawes .
1,979,283 11/1934 Osborn ..... 283/66
4,556,390 12/1985 Rahn et al. ..... 434/433
5,066,046 11/1991 Hoopingarner ..... 283/70
5,261,702 11/1993 Mayfield ..... 283/115
5,333,908 8/1994 Dorney et al. ..... 283/38

*Primary Examiner*—Willmon Fridie, Jr.
*Attorney, Agent, or Firm*—Maurice L. Miller, Jr.

[57] ABSTRACT

A method for indicating and tracking the progress of activities is disclosed wherein a table containing a calendar covering at least a portion of a calendar year is provided. Activities which are intended to be undertaken during the period of time covered by the calendar are listed in the table and a group of symbols is selected, which symbols are representative of the status and relative priority of such listed activities from commencement through completion or abandonment thereof. The symbols should be readily modifiable so that they can be altered to represent changes in the status and priority of the activities as such status and priority changes occur.

13 Claims, 3 Drawing Sheets

METHOD FOR RECORDING AND TRACKING THE PROGRESS OF ACTIVITIES

BACKGROUND OF THE INVENTION

This invention relates generally to methods for recording priorities for activities to be undertaken and for keeping track of the progress of such activities from commencement to completion or abandonment. More specifically, this invention relates to a method for providing a chart for listing such activities which contains a calendar upon which such activities can be targeted for commencement on selected dates. Symbols which are readily modifiable when necessary can be applied to the chart to update and track the progress of such activities.

Broadly speaking, charts and systems containing calendars have been used in the prior art to practice well known methods for the management of time in the planning for the undertaking of activities, tasks and projects of all kinds. One such prior art system and method is that known by the registered trademark, Priority Management®, wherein various activities are listed on a chart containing a calendar and are targeted for undertaking during a selected time period on a selected date. A major difficulty encountered when using such a system is that specific activities listed, no matter how routine in their character, often seem to take more time to complete than first appears necessary. Sometimes, due to a host of unforeseen circumstances, the simplest of activities, such as, for example, the making and completing of a routine telephone call can take much more time and many more attempts than originally anticipated. Often, it is not even possible to successfully establish a telephone call to a particular person at the specific time and date set aside for that activity.

Nowhere is the precise setting of time for the commencement and completion of a specific task more frustrating than in the practice of law. Office conferences, preparation of briefs, motions and pleadings, preparation of patent applications, etc. often take more time than anticipated and, sometimes, a great deal more time than initially expected. Under such circumstances, the setting of a time period for the accomplishment of such a task is often an exercise in futility. Sometimes the mere exercise of establishing the amount of time necessary to complete a project, aside from often being a matter of guess work, is, itself, a time consuming activity.

Another problem encountered with such prior art time management processes is they do not provide for tracking the progress of a task or activity and for readily updating the status thereof after the activity has been commenced, in circumstances where the matter takes more than one day to complete.

By means of the method of my invention, these and other difficulties encountered using prior art time management processes and methods are substantially overcome.

SUMMARY OF THE INVENTION

It is an object of my invention to provide a novel method for recording, prioritizing and tracking the progress of activities.

It is a further object of my invention to provide a novel method for recording and tracking the progress of activities using symbols which can be readily modified to show changes in progress from commencement to completion or abandonment of the activities.

Briefly, in accordance with my invention, there is provided a method for indicating selected dates for the commencement of specific activities and for documenting the status of the activities. The steps of the method include providing at least one table for itemizing a series of specific activities to be undertaken along and within separate segments of a first axis and for establishing a selected number of successive dates representing a selected portion of a calendar year during which the activities are to be undertaken. The successive dates are represented by successive segments of a second axis, the first and second axes intersecting one another to form the table. The steps also include selecting a group of symbols representative of the status of the activities. The steps further include listing at least one of the activities along and within a selected one of the segments of the first axis which is intended to be undertaken during the span of dates represented on the second axis. The steps still further include placing a selected one of the symbols representative of the status of the one of the activities in an area defined by the intersection of the selected one of the first axis segments and a second axis segment representing the date upon which the at least one of the activities is to be or has been undertaken.

These and other objects, features and advantages of my invention will become apparent to those skilled in the art from the following detailed description and attached drawings upon which, only a preferred embodiment of my invention is illustrated.

DESCRIPTION OF THE PREFERRED EMBODIMENT

Figure 1:
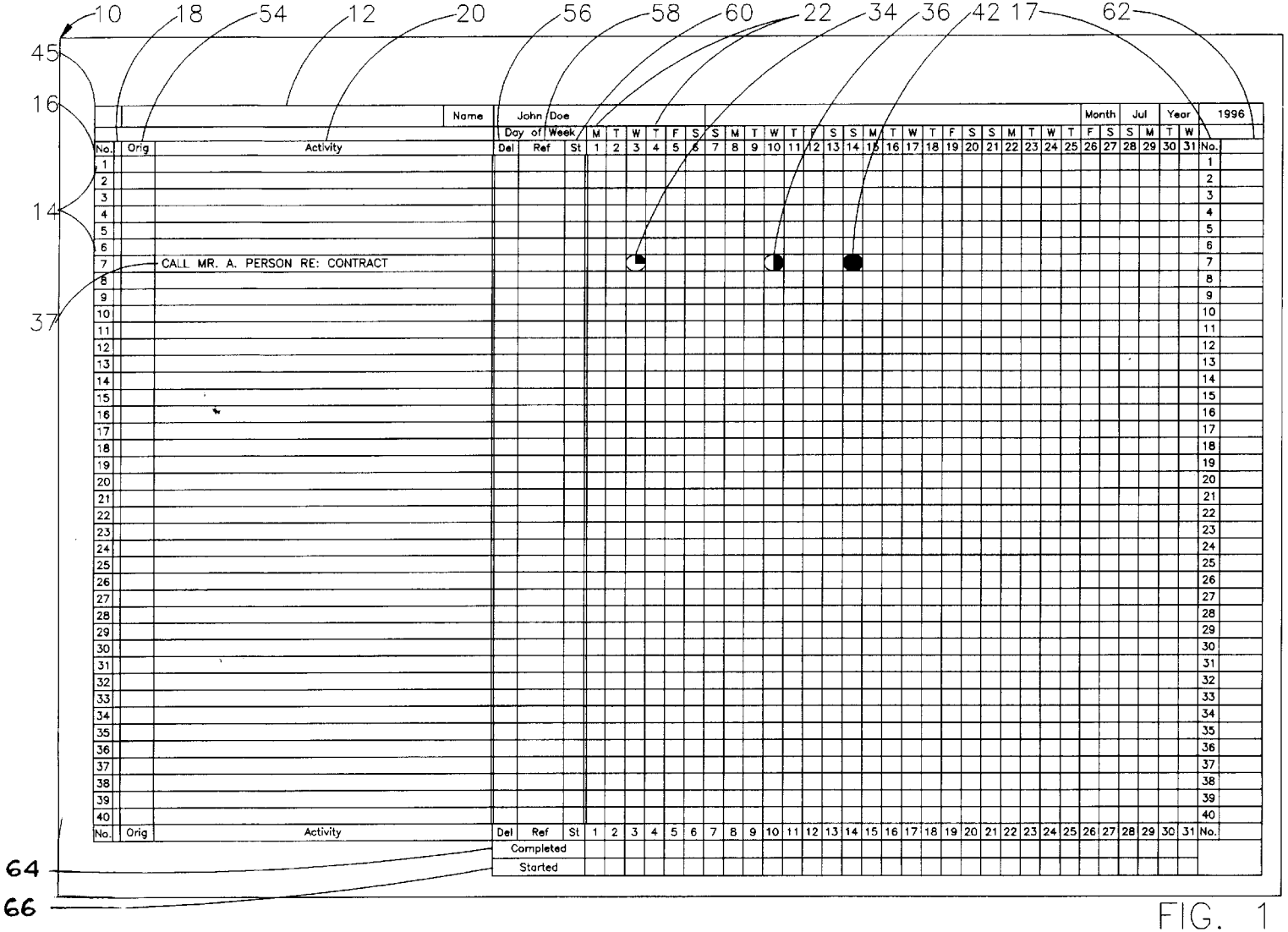
FIG. 1 shows a plan view of a sheet containing a table which can be provided and used in accordance with the steps of the activities management method of my invention.

Referring now to the drawing Figures and, in particular, to FIG. 1, there is shown a sheet generally designated 10 containing a chart or table 12 which is provided in accordance with my invention. The vertically extending left hand border of the table 12 lies along a first axis and is segmented so as to form any desired number of horizontally extending rows 14. A column 16 is provided on a left hand side portion of the table 12 containing the numbers of each of the rows 14 which, in the present example, extends downwardly from "1" to "40". In the present example, a similar column 17 exists on a right hand portion of the table 12 for clarity of line identification when working on a right hand portion of the sheet 10. Immediately to the right of the row number column 16 is a narrow column 18. The small blocks thus formed in column 18 in each of the rows 14 can be readily filled in or darkened by pen or pencil to indicate that action has been initiated on the activities listed on the corresponding rows. To the immediate right of the column 18 is an origination column 54 which can be filled in with a date that an activity specified on the same line of the next column to the right is written down. To the immediate right of the column 54 is an activity description column 20 wherein up to forty activities can be briefly described and itemized or listed on the rows 14. To the immediate right of the column 20 is a delegate identification column 56 wherein the name, initials, or other identifying mark of a person to whom the activity in the same row is to be or has been delegated may be placed. To the immediate right of the column 56 is a reference column 58 wherein a brief designation of the location of the reference materials pertinent to the corresponding activity may be placed. Such materials may include notes, sketches, files, diagrams, notebooks and the like. To the immediate right of the column 58 is a status column 60 which may be used when an activity being listed on a sheet is one which is being carried forward from a sheet covering a prior time period. In such a case, a symbol or modified symbol from FIG. 3 which is representative of the status of the activity at the time it is carried forward from a prior to the subsequent sheet would be placed in the column 60. To the immediate right of the column 17 is a column 62 which may be used to record a brief note of any helpful nature relative to the corresponding activity as determined by the user. For example, where an activity involves a telephone call, the recipient might request a call back on a certain future date beyond those dates shown on the sheet, which call back date could conveniently be placed in the column 62 for future carry forward to a subsequent sheet. To the immediate right of the column 60 is a series of columns 22 for successive days or dates of a selected portion of a calendar year, which portion, in the present example, is a specific one month time period, namely, July, 1996. Accordingly, there are thirty one columns 22, one for each day in the month of July. The days of the month or date columns 22 are thus formed from segments of a horizontally extending second axis of the table 12. At the bottom of the table 12 are two segmented rows 64 and 66 labeled "completed" and "started", respectively which are below the columns 22. The segments of the row 64 are defined by intersection with the date columns 22 and may be used to record the number of activities listed on the sheet 10 which have been completed through a given date. The segments of the row 66 defined by intersection with the date columns 22 may be used to record the number of activities listed on the sheet 10 which have been commenced through a given date.

The table 12 is what I refer to as a generic table in that activities of any conceivable kind or type which are intended to be undertaken within the month of July, may be listed in column 20 for tracking in the columns 22 of the corresponding rows 14. Examples of such activities include a contact and/or conversation to be had with another person or group of persons, such as by telephone or data transmission, and tasks to be performed. Tasks can include virtually any conceivable activity such as paying a bill, balancing a checkbook, shopping for a computer, baking a cake for a birthday or other occasion, repairing a broken window, writing a letter, raking leaves, planting flowers, building a bird house, making a telephone call and so on. The activities may be either business or non-business related or both.

Figure 3:
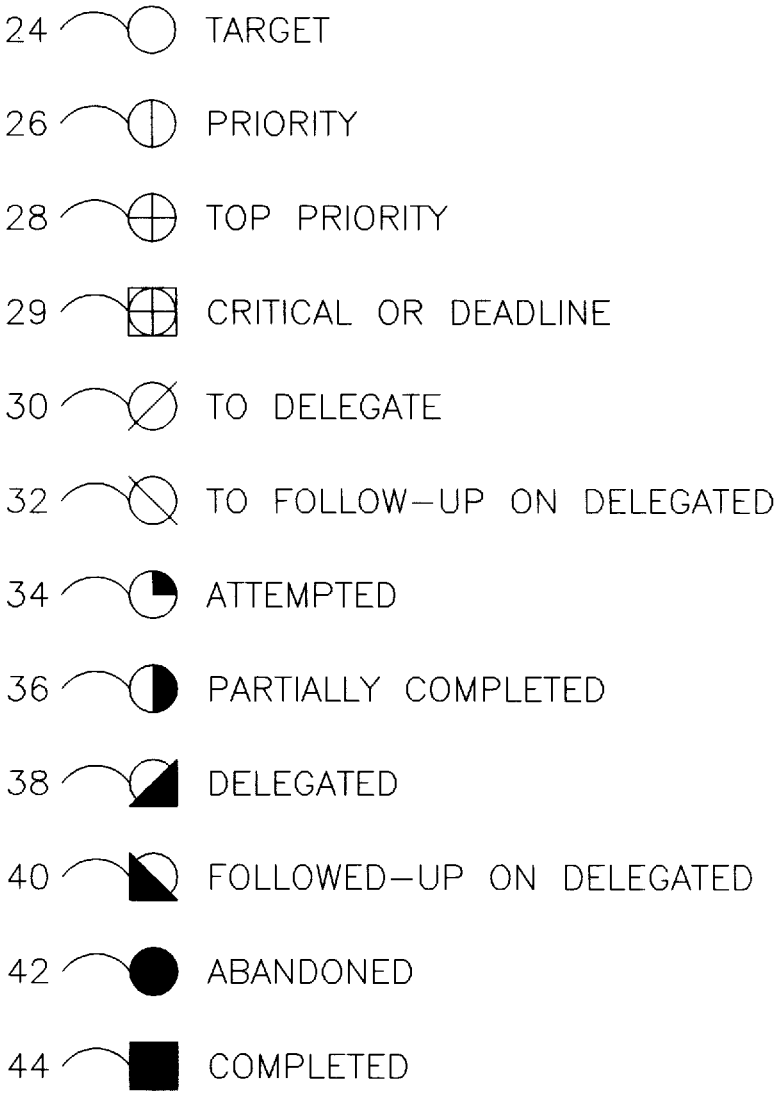
FIG. 3 shows a list of printed characters which can be used in the tables of FIGS. 1–2 in executing the steps of the method of my invention, each of the characters having a brief statement of its meaning set out opposite thereto.

Referring now additionally to FIG. 3, there is shown a group of printed characters or symbols which can be used in the table 12 of FIG. 1 to represent the status of the various activities listed in column 20. These particular characters are preferred because of the ease with which they can be printed by hand in the table 12 and because they can be readily modified to track or update the status of such activities as changes in status occur. The characters include a clear circular target symbol 24 which can be placed in a selected one of the date columns 22 to indicate the date upon which a given one of the activities on a given row 14 listed in column 20 is intended to be undertaken. If the subject activity is a matter of priority or, at least, will become a matter of priority on a given date, or, if it has become a matter of priority since the target symbol 24 was originally placed in the table 12, a vertical line may be added to the target circle 24 to so indicate as shown in FIG. 3 at 26. If the activity is, will or has become one of top priority on the date selected for its undertaking, a vertical and a horizontal line may be drawn through the otherwise clear target circle 24 or a horizontal line may be drawn through the priority symbol 26 to produce an encircled cross, which is a top priority symbol as at 28 in FIG. 3. If the activity is, will or has become one of a critical or deadline priority on the date selected for its undertaking, the area or block in which the top priority symbol 28 has been placed can be outlined with pen or pencil to form a critical or deadline symbol as at 29 in FIG. 3. Similarly, the symbols 24 and 26 can be readily modified by pen or pencil to form the critical or deadline symbol 29. The appropriate target symbol 24, 26, 28 or 29 for a given activity is selected and placed in the area representing the date selected for the intended undertaking of the activity in the row 14 upon which the corresponding activity is listed.

A second group of symbols 30, 32, 34 and 36 can be used to target and track activities in the table 12 having to do with delegation and follow-up thereof. Suppose, for example, a user intends to delegate a selected activity to an employee. The user would write a brief description of the task or activity in column 20 on one of the blank rows 14 and set a target date for delegating that matter to an employee by placing the symbol 30, which is a clear circle with an upward-to-the-right, diagonally extending line therethrough, on that row in the selected date column 22. Symbols 26, 28 and 29 can be formed over the symbol 30 to indicate an appropriate level of higher priority. Then, once the matter has actually been delegated, the user can indicate that fact by simply darkening or filling in with pen or pencil a lower right half portion of the block containing the symbol 30 to form a delegated symbol as at 38.

Now suppose for example that, in June, 1996, a matter has been targeted to be delegated on a future date during the first week of July by use of the symbol 30. Then, suppose on that target date, the matter is actually delegated wherein the symbol 30 is readily modified to form the delegated symbol 38. At that point in time, the delegating party may wish to follow-up on the delegated matter by checking with the person to whom the matter has been delegated at a later date as to the progress thereof and suppose the user wishes to do so on a date certain during the second week of July. On the row 14 of the July sheet which contains the subject activity, the user should place a symbol 32, symbolic of intent to follow-up on the delegated matter, in the date column 22 which has been selected as the specific date for such follow-up. Notice that the to follow-up on delegated symbol 32 is a clear circle having a downward-to-the-right, diagonally extending line therethrough. Here again, the symbols 26, 28 and 29 can be formed over the symbol 32 to indicate an appropriate level of higher priority. Then, when the delegated matter to be followed-up is, in fact, followed-up, the symbol 32 is readily modified to form a symbol 40 by simply filling in with pen or pencil a lower left hand half of the block containing the symbol 32.

With continuing reference to FIGS. 1 and 3, a pair of symbols 34 and 36 is provided which represents an attempt to work on an activity or make a contact as, for example, by telephone with another person or group of persons, and partially completing work on an activity or partially completing a communication with another person or persons, respectively. Suppose, for example, that an activity listed on one of the rows 14 involves making a telephone call to a specific person (See 37 in FIG. 1) to discuss the terms to be included in a contract being negotiated. The matter would be targeted for undertaking on a date certain by placing the appropriate target symbol 24, 26, 28 or 29 in the selected date column 22 as previously explained. Suppose, further, that on the target date, the telephone call is made but a communication with the person being called does not take place. Upon such an occurrence, the upper right hand quadrant of the symbol 24, 26, 28 or 29 would be filled in by pen or pencil to form the symbol 34 (See also FIG. 1) overlying the selected target symbol, indicative of the attempted contact and a new target date using another one of the symbols 24, 26, 28 or 29 could be selected and entered into a selected future date column 22. Now assume that on the second selected date, the telephone call is successfully made in which five of seven specific contract issues are discussed and resolved, leaving two issues to be resolved in a future telephone call. In this latter event, target symbol 24, 26, 28 or 29 used on the second selected date would be modified by filling in the right half thereof with pen or pencil to form the partially completed symbol 36 (See also FIG. 1) overlying the selected target symbol and a third target symbol 24, 26, 28 or 29 would be placed in a future selected date area of the column 22 in the row 14 on which the activity is listed.

The last two symbols 42 and 44 represent the status of activities which become abandoned for any reason and those which are successfully completed, respectively. Returning to the example of the telephone call for negotiating the terms of a contract, suppose that, on the third selected target date which has been set using one of the target symbols 24, 26, 28 or 29, circumstances change such that the telephone caller no longer wishes to complete the two unresolved issues under the proposed contract because the caller no longer wishes to enter into the contract. To represent the abandonment of this matter, the caller would simply fill in the circle of the last symbol used to form the abandoned symbol 42 (See also FIG. 1). On the other hand, suppose that a final telephone call is placed on the third selected target date, during which conversation, the two remaining issues of the contract negotiation are successfully concluded. In that event the full block would be filled in with pen or pencil to form the symbol 44 indicative of completion of the negotiation. Suppose now that the subject contract negotiation had not been successfully concluded and has become delayed for some reason such that a further telephone conference with the other party must be had in the following month, August, 1996, for example. The incomplete matter can then be simply carried over to a blank row of a new sheet 10 containing the table 12 except that the new table is adapted for the month of Aug., 1996. Accordingly, a date in August for the further telephone conference is selected and an appropriate target symbol 24, 26, 28 or 29 is placed in the selected date column 22 of the new table in the block on a row 14 of the August table on which the unfinished activity has been listed.

Where more matters are to be targeted for undertaking in a given month than there are rows 14 available on a single sheet for listing them, an additional table 12 for the month may be provided. In such case, the first sheet used during a given month can be marked with a "1" in the block 45 in FIG. 1 and the second sheet for that month can be marked with a "2" in the corresponding block of that sheet and so on, depending on the number of sheets used during the subject months.

Figure 2:
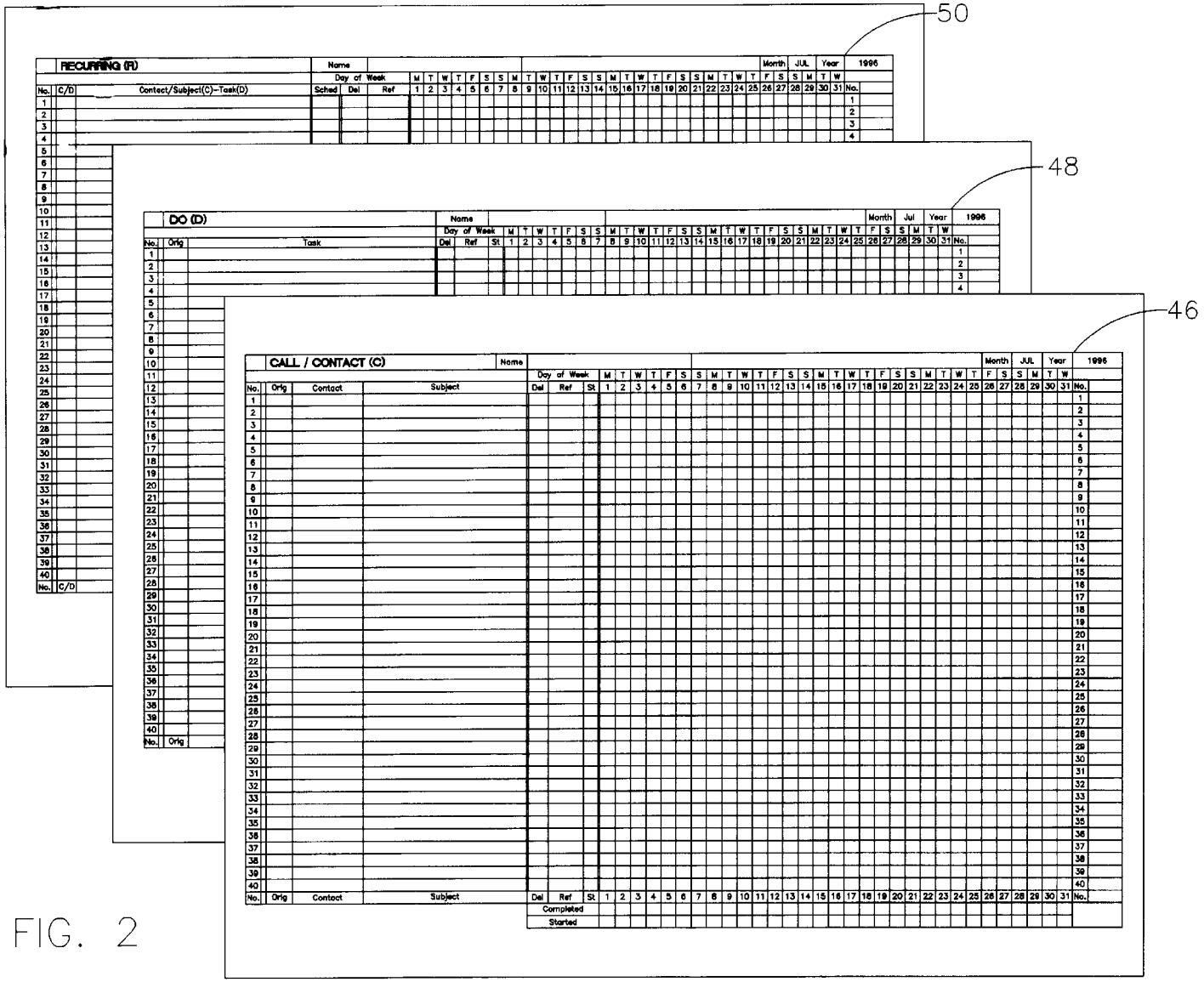
FIG. 2 shows a plan view of portions of three partially overlapping sheets, each of the sheets containing a table of one month duration, the three tables being for use in keeping track of the status of three different classes of activities in accordance with my invention.

Referring now additionally to FIGS. 2 and 3, there are shown portions of three different tables 46, 48 and 50 of three different sheets which relate to three different categories of activities. As in the previous example of FIG. 1, these are activities which are intended to at least be targeted for undertaking, if not completion, during the portion of the calendar year indicated on the sheet. They are the same type of activities as would have been consolidated on the single table 12 of FIG. 1 except that, here, they are separated into three categories and, then, prioritized and tracked on three separate tables. The table 46 is entitled CALL/CONTACT and is adapted for listing and tracking only those activities which involve a two-way communication with other people or groups of people such as by way of face-to-face conferences, telephone calls, radio communications, interactive computer communications and the like. The table 48 is entitled DO and is essentially a things-to-do list, which includes activities other than calls or contacts as previously described. The table 50 is entitled RECURRING and involves tasks which recur on a regular basis such as monthly, quarterly, semi-annually or otherwise. Examples of such recurring activities include the making of monthly rent and mortgage payments, recurring telephone calls, regular dues payments, taking vitamins, regular exercising, making monthly charge card payments, making quarterly estimated income tax payments and the like. The activities listed in tables of the sheets 46, 48 and 50 are targeted for undertaking by selecting target dates in the date columns of those tables using the symbols 24, 26, 28 and 29 of FIG. 3, the same as in the previous example of FIG. 1. Thereafter, the target symbols can be modified to update and track the progress of those activities in the same manner as previously explained.

The table 12 of FIG. 1 and the tables 46, 48 and 50 of FIG. 2 are exemplary only. The portion of the calendar year used in these tables could be any suitable portion of a calendar year other than the one month period shown, such as, for example, a week, quarter, annual or semi-annual portion of a calendar year as well as a full calendar year. As used herein, the term portion of a calendar year means any desired portion of a calendar year of one day or more up to and including a full calendar year. The tables 12, 46, 48 and 50 could also include a range of dates of greater than one year duration if desired.

Although the present invention has been described with respect to specific details of a certain preferred embodiment thereof, it is not intended that such details limit the scope of this patent other than as expressly set forth in the following claims.

I claim:

1. A method for indicating selected dates for the commencement of specific activities and for documenting the status of said activities, the steps of which comprise providing at least one table for itemizing a series of specific activities to be undertaken along and within separate segments of a first axis and for establishing a selected number of successive dates representing a selected portion of a calendar year during which said activities are to be undertaken, said successive dates being represented by successive segments of a second axis, said axes intersecting one another to form said table, selecting a group of symbols representative of a status of said activities, listing at least one of said activities along and within a selected one of the segments of said first axis which is intended to be undertaken during the span of corresponding dates represented on said second axis, placing a selected one of said symbols representative of the status of said one of said activities in an area defined by the intersection of said selected one of said first axis segments and a second axis segment representing the corresponding date upon which said at least one of said activities is to be or has been undertaken, and modifying the selected one of said symbols in said area to form another one of said symbols to represent a change in the status of said one of said activities.

2. The method of claim 1 wherein said group of symbols includes symbols representing a priority for intended future commencement of an activity and intended delegation of an activity to be performed by another person.

3. The method of claim 1 wherein said group of symbols includes symbols representing an attempt to communicate with another person and a communication with another person which is partially completed.

4. The method of claim 1 wherein said group of symbols includes symbols which represent an activity which has been delegated, a delegated activity to be followed-up in the future, and a delegated activity which has been followed-up.

5. The method of claim 1 wherein said group of symbols includes symbols representing an activity which is partially completed, an activity which is abandoned and an activity which is completed.

6. The method of claim 1 wherein said specific portion is one calendar month.

7. The method of claim 1 wherein said specific activities comprise two way communications to be made to other persons.

8. The method of claim 1 wherein said specific activities comprise personal contacts made and intended to be made with other persons.

9. The method of claim 1 wherein said specific activities comprise matters which require the performance of specific tasks.

10. The method of claim 1 wherein said group of symbols includes symbols representing a priority activity, a top priority activity and a critical or deadline activity.

11. The method of claim 1, the steps of which further comprise modifying the selected one of said symbols in said area to form another one of said symbols to represent a change in said priority.

12. A method for indicating selected dates for the commencement of specific activities and for documenting the priority of said activities, the steps of which comprise providing at least one table for itemizing a series of specific activities to be undertaken along and within separate segments of a first axis and for establishing a selected number of successive dates representing a selected portion of a calendar year during which said activities are to be undertaken, said successive dates being represented by successive segments of a second axis, said axes intersecting one another to form said table, selecting a group of symbols representative of a priority of said activities, listing at least one of said activities along and within a selected one of the segments of said first axis which is intended to be undertaken during a span of corresponding dates represented on said second axis, placing a selected one of said symbols representative of the priority of said one of said activities in an area defined by the intersection of said selected one of said first axis segments and a second axis segment representing the corresponding date upon which said at least one of said activities is to be or has been undertaken, and modifying the selected one of said symbols in said area to form another one of said symbols to represent a change in the priority of said one of said activities.

13. A method for indicating selected dates for the commencement of specific activities and for documenting the status and priority of said activities, the steps of which comprise providing at least one table for itemizing a series of specific activities to be undertaken along and within separate segments of a first axis and for establishing a selected number of successive dates representing a selected portion of a calendar year during which said activities are to be undertaken, said successive dates being represented by successive segments of a second axis, said axes intersecting one another to form said table, selecting a group of symbols representative of a status and priority of said activities, listing at least one of said activities along and within a selected one of the segments of said first axis which is intended to be undertaken during the span of corresponding dates represented on said second axis, placing a selected one of said symbols representative of the status and priority of said one of said activities in an area defined by the intersection of said selected one of said first axis segments and a second axis segment representing the corresponding date upon which said at least one of said activities is to be or has been undertaken, and modifying the selected one of said symbols in said area to form another one of said symbols to represent a change in the status and priority of said one of said activities.

* * * * *